US006119421A

United States Patent [19]

Koyano

[11] Patent Number: 6,119,421

[45] Date of Patent: Sep. 19, 2000

[54] COLUMN FRAME WITH OPENING PREVENTIVE UTENSILS

[75] Inventor: Yashirou Koyano, Shimotsuga-gun, Japan

[73] Assignee: Polymer Shoukou Co., Ltd., Tochigi, Japan

[21] Appl. No.: 09/117,160

[22] PCT Filed: Feb. 16, 1998

[86] PCT No.: PCT/JP98/00617

§ 371 Date: May 4, 1999

§ 102(e) Date: May 4, 1999

[87] PCT Pub. No.: WO98/41695

PCT Pub. Date: Sep. 24, 1998

[30] Foreign Application Priority Data

Mar. 17, 1997 [JP] Japan ..... 9-083256

[51] Int. Cl.[7] ..... E04C 2/30

[52] U.S. Cl. ..... 52/296; 52/299; 249/48; 220/4.25

[58] Field of Search ..... 52/296, 297, 299; 249/51, 48; 220/4.24, 4.25

[56] References Cited

U.S. PATENT DOCUMENTS 4,083,526 4/1978 Hatfield ..... 249/48
4,905,822 3/1990 Bosco ..... 220/4.24
5,832,675 11/1998 Zuares ..... 52/296 X
5,909,984 6/1999 Matthews ..... 249/48

FOREIGN PATENT DOCUMENTS 52-72307 5/1977 Japan .
3-28422 2/1991 Japan .
9-59999 3/1997 Japan .

*Primary Examiner*—Richard Chilcot
*Attorney, Agent, or Firm*—Armstrong, Westerman, Hattori, McLeland & Naughton

[57] ABSTRACT

The present invention relates to an improvement of a column base frame which is used for forming a column base which is used for supporting a column during construction of a building. According to the present invention, there is provided a column base frame with an opening prevention tool, wherein the opening prevention tool is mounted between protruding plates of the column base frame assembled by connecting L-shaped corner frames, each comprising fitting holes and cylindrical fitting holes on one end thereof; movable protrusions, inserting protrusions and cylindrical protrusions on the other end thereof; and protruding plates through which through holes are bored. There is also provided a column base frame with an opening prevention tool, wherein the opening prevention tool is mounted between the protruding plates, through which the through holes are bored, of the column base frame assembled by connecting increased frames to L-shaped corner frames.

6 Claims, 18 Drawing Sheets

COLUMN FRAME WITH OPENING PREVENTIVE UTENSILS

TECHNICAL FIELD

The present invention relates to an improvement of a column base frame which is used for forming a column base for supporting a column during construction of a building.

BACKGROUND ART

A conventional column base frame has been manufactured by a method of pouring synthetic resin into a constantly-shaped molding frame and hardening the resin. For a column base serving as a base of a column, it is necessary to manufacture the column base frames of large and small sizes in accordance with the size of the column. Thus, there is a need for forming the column bases of large and small sizes in response to the size of the column, which causes the large and small column base frames to be individually manufactured.

However, the conventional column base frame has the following shortcomings.

Firstly, since the column base frame integrally manufactured by the molding frame, such as the conventional column base frame for forming the column base for supporting a piping or the like, is formed into a constant shape, the column base frame is bulky during carrying it. This causes a carrying cost to be too expensive.

Secondly, the column base frame is integrally formed into a predetermined shape. Therefore, if an attempt is made to mount the column base frame to the column base for supporting an iron column for supporting the piping in order to more tightly support the iron column, the column base frame cannot be mounted to the column base.

Thirdly, in case of the column base frame for forming the column base of the column for supporting the piping and the column base frame for forming the column base for supporting the iron column or the like, if the attempt is made to increase the size of the column base, the column base frame itself cannot be increased in size, that is, increased in number. Therefore, the conventional old column base cannot be reinforced.

Fourthly, when fresh concrete is poured into the column base frame, the column base frame is disadvantageously deformed due to a weight of the fresh concrete.

It is therefore an object of the present invention to provide a column base frame with an opening prevention tool which is not bulky during carrying it by an assembled column base frame, can be mounted to the base of the column for supporting the piping, can be increased in number, can be easily assembled, and is not deformed even if the fresh concrete is poured into the column base frame.

DISCLOSURE OF THE INVENTION

According to one aspect of the present invention, there is disclosed a column base frame with an opening prevention tool, wherein the opening prevention tool is mounted between the protruding plates of the column base frame assembled by connecting L-shaped corner frames, each comprising fitting holes and cylindrical fitting holes on one end thereof; movable protrusions, inserting protrusions and cylindrical protrusions on the other end thereof; and protruding plates through which through holes are bored.

According to another aspect of the present invention, there is disclosed a column base frame with an opening prevention tool, wherein the opening prevention tool is mounted between the protruding plates, through which the through holes are bored, of the column base frame assembled by connecting increased frames to L-shaped corner frames, the L-shaped corner frame comprising fitting holes and cylindrical fitting holes on one end thereof; and movable protrusions, inserting protrusions and cylindrical protrusions on the other end thereof, and the increased frame comprising fitting holes and cylindrical fitting holes on one end thereof; movable protrusions, inserting protrusions and cylindrical protrusions on the other end thereof; and protruding plates through which through holes are bored.

BEST MODE FOR CARRYING OUT THE INVENTION

The present invention will be described below with reference to the accompanying drawings.

Figure 1:
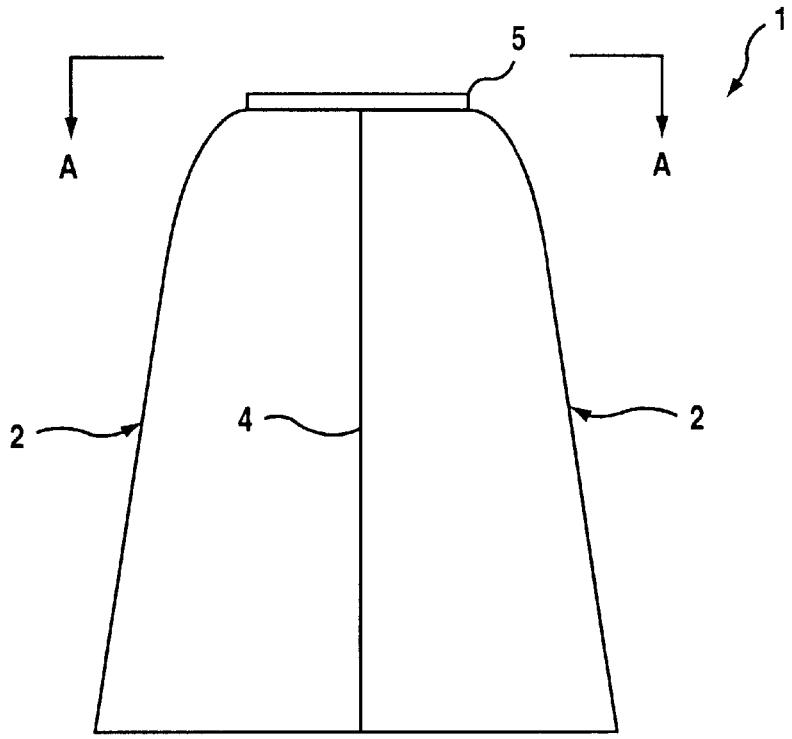
FIG. 1 is an elevational view of a column base frame with an opening prevention tool according to the present invention.
Figure 2:
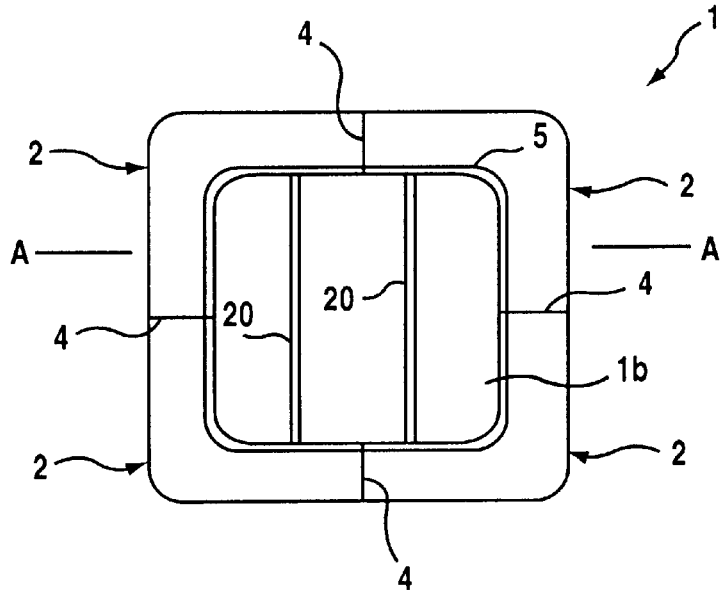
FIG. 2 is a plan view of the column base frame with the opening prevention tool according to the present invention.

FIG. 1 is an elevational view of a column base frame with an opening prevention tool according to the present invention. FIG. 2 is a plan view of the column base frame with the opening prevention tool according to the present invention.

As shown in FIGS. 1 and 2, a column base frame 1 with an opening prevention tool of the present invention is assembled by preparing four corner frames 2 shown in FIGS. 3–6 and connecting the four corner frames 2, 2, 2, 2, and a plurality of opening prevention tools 20, 20 are mounted in the assembled column base frame 1 with the opening prevention tool. Numeral 4 denotes a connecting portion of the corner frames 2 and 2. Of course, the column base frame 1 may have a structure in which the prevention tools 20, 20 are not mounted therein.

Figure 3:
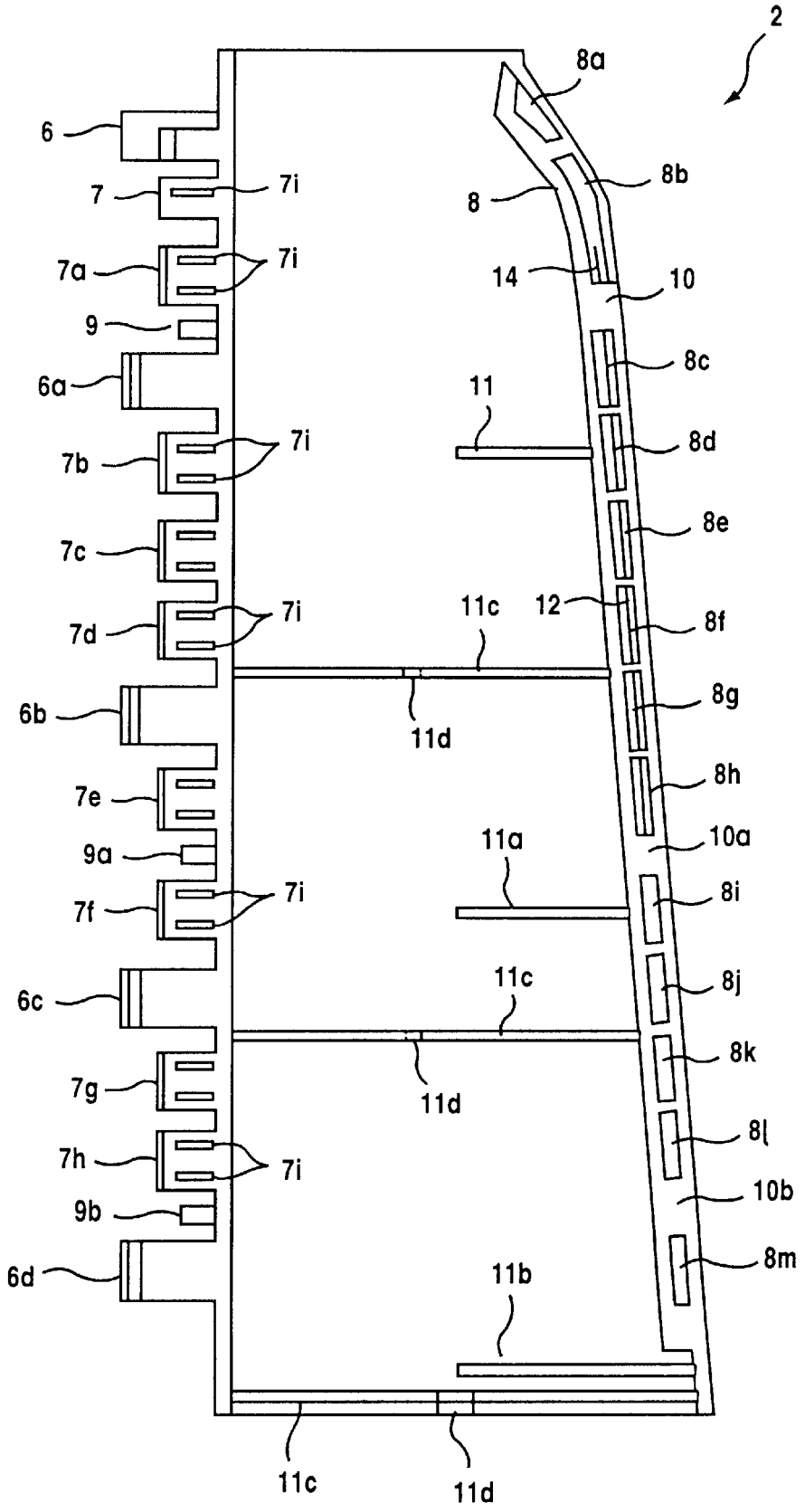
FIG. 3 is an elevational view of a corner frame constituting the column base frame with the opening prevention tool according to the present invention.
Figure 4:
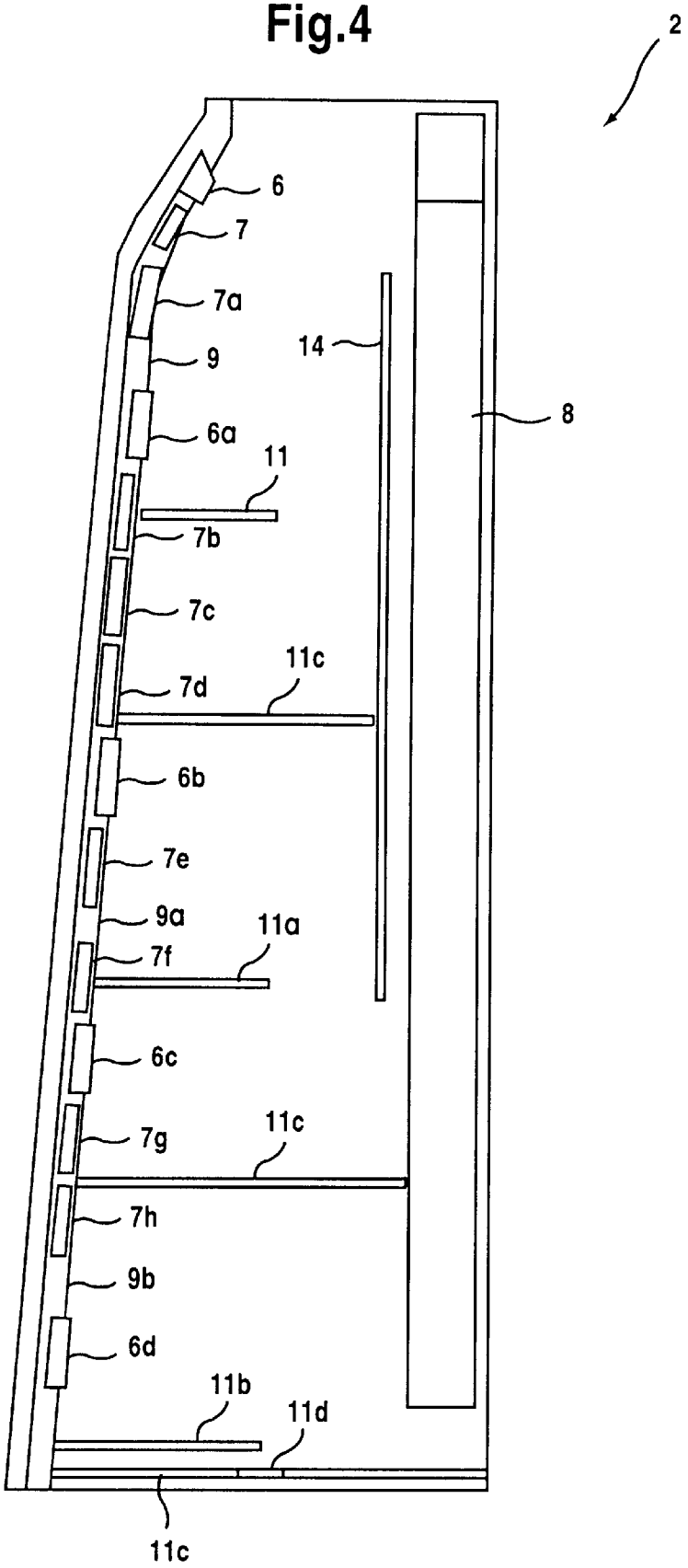
FIG. 4 is a left side view of the corner frame constituting the column base frame with the opening prevention tool according to the present invention.

FIGS. 3 and 4 show the corner frame constituting the present invention. In the first place, FIG. 3 is an elevational view of the corner frame constituting the column base frame with the opening prevention tool according to the present invention. FIG. 4 is a left side view of the corner frame 2 constituting the column base frame according to the present invention.

A plurality of fitting holes 8–8*m* are formed in a fitting formation portion 8 on the right end of the corner frame 2 shown in FIGS. 3 and 4. A plurality of movable protrusions 6–6*d*, inserting protrusions 7–7*g* and cylindrical protrusions 9–9*b* are formed on the left end of the corner frame 2. One surface of the end of each of the movable protrusions 6–6*d* is formed into an arrowhead shape so that, when it is fitted into the other corner frame 2, it may be engaged with and may not be removed from the other corner frame 2.

Numerals 11–11*b* denote horizontal protruding bars. These horizontal protruding bars 11–11*b* are used for reinforcing a strength of the corner frame 2. Numeral 14 denotes vertical protruding bars. These vertical protruding bars 14 are used for increasing the strength of the corner frame 2. It should be noted that the horizontal protruding bars 11–11*b* and the vertical protruding bars 14 may not be provided.

Numeral 11*c* denotes protruding plates. Numeral 11*d* denotes through holes. The protruding plates 11*c* are used for preventing the column base frame from rising due to a pressure and a weight of fresh concrete when the fresh concrete is filled into the assembled column base frame. The through holes 11*d* are used for preventing the column base frame from rising by passing bolts therethrough and driving the bolts into the ground and for inserting the opening prevention tools 20 and opening prevention bands 21 thereinto. It should be noted that the protruding plates 11*c* and the through holes 11*d* for passing the bolts therethrough may not be provided as required.

Numerals 7*i*, 7*i*, 7*i*, . . . denote fitting protruding bars. These fitting protruding bars 7*i*, 7*i*, 7*i*, 7*i*, . . . are used for making the fitting more tight when the inserting protrusions 7–7*h* are inserted/fitted into the fitting holes 8*a*–8*m* during the assembly. Vertical protrusions may be also disposed in the similar positions on the rear surfaces of the inserting protrusions 7–7*h* or on the ends of the inserting protrusions 7–7*h*. Of course, no protrusions may be disposed on the front and rear surfaces of the inserting protrusions 7–7*h*.

Figure 5:
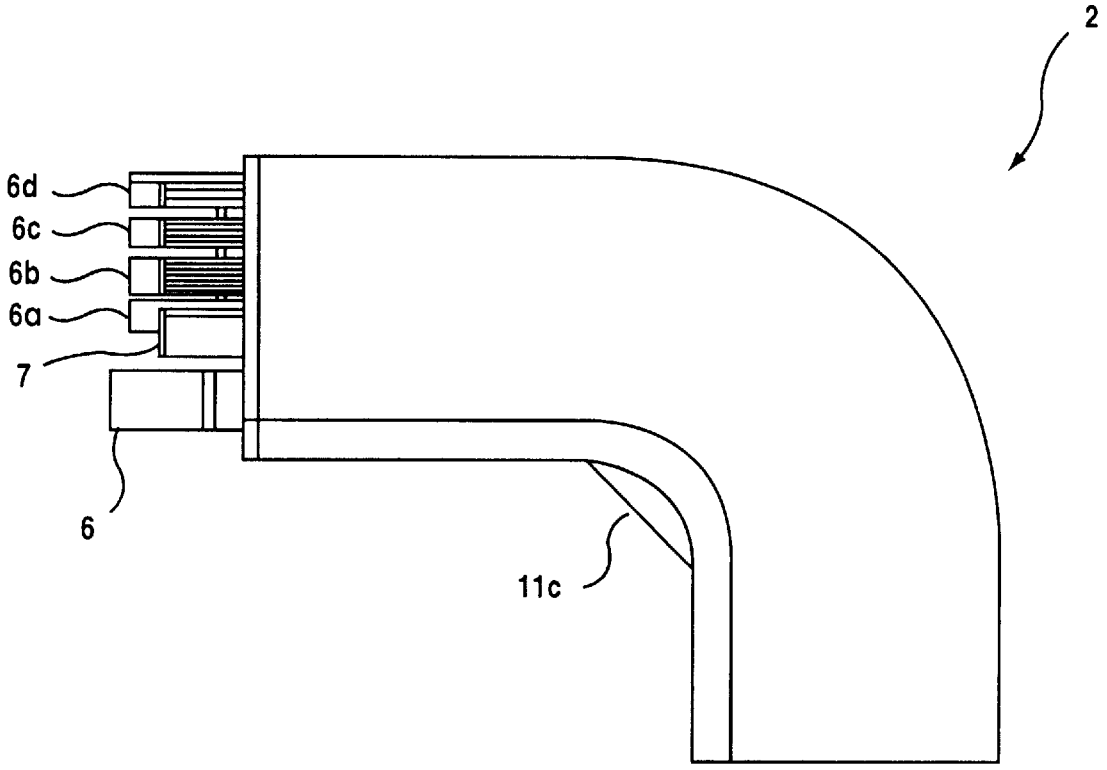
FIG. 5 is a plan view of the corner frame constituting the column base frame with the opening prevention tool according to the present invention.
Figure 6:
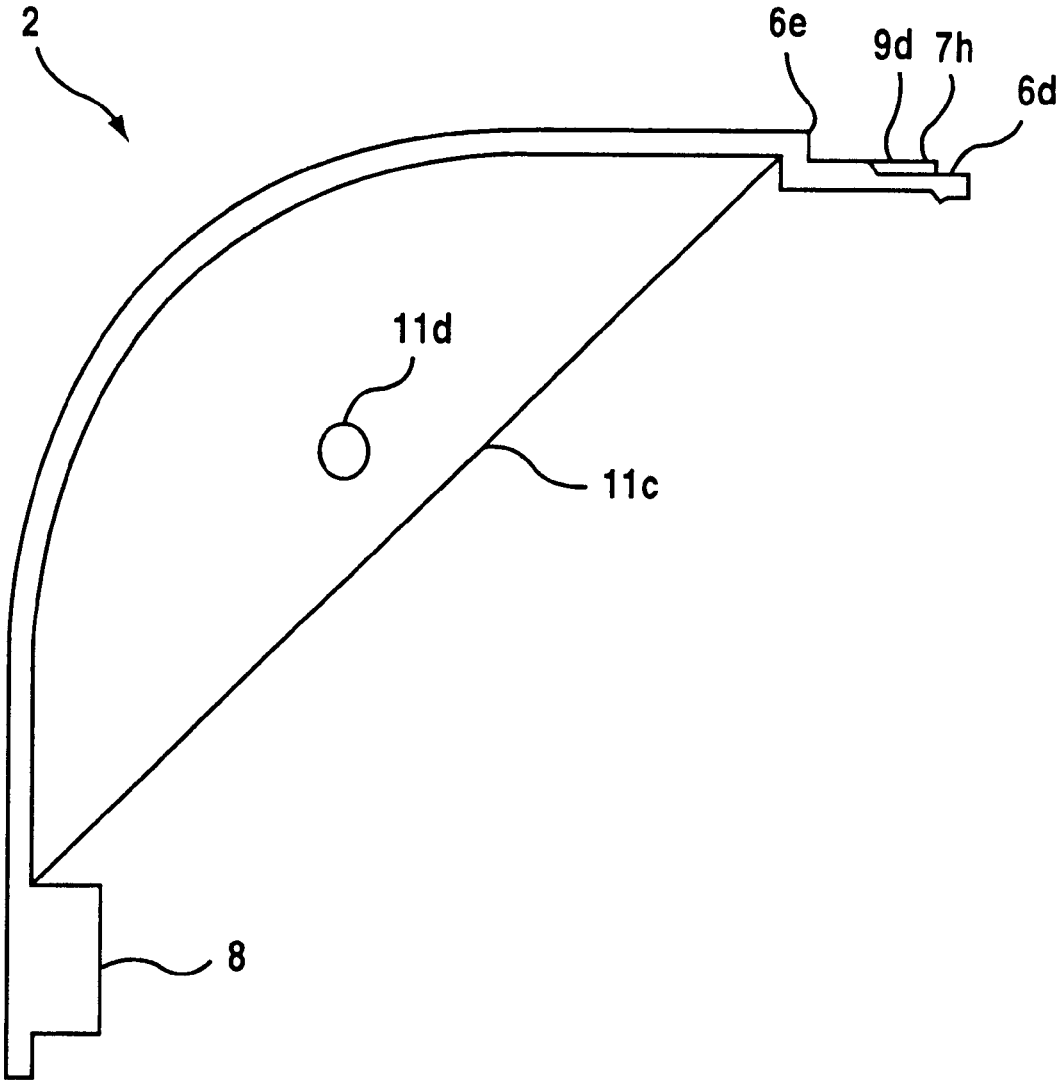
FIG. 6 is a bottom view of the corner frame constituting the column base frame with the opening prevention tool according to the present invention.

FIG. 5 is a plan view of the corner frame constituting the column base frame with the opening prevention tool according to the present invention. FIG. 6 is a bottom view of the corner frame constituting the column base frame with the opening prevention tool according to the present invention. As shown in FIGS. 5 and 6, the corner frame 2 is curved so that it may be generally L-shaped. The four corner frames 2 of the same shape and the same size are connected to each other, whereby a single column base frame 1 with the opening prevention tool shown in FIGS. 1 and 2 is completed.

Numeral 6*e* in FIG. 6 denotes a step. Due to this step, when the corner frames 2, 2, 2, 2 are connected to each other so as to be assembled, the corner frames are completely bonded to each other. Therefore, the fresh concrete poured into the column base frame 1 with the opening prevention tool is not leaked outwardly from the column base frame 1.

In order to connect the corner frames 2 and 2, the movable protrusions 6–6*d* and the inserting protrusions 7–7*h* are fitted into the fitting holes 8*a*–8*m* formed in the fitting formation portion 8 on the right end and the cylindrical protrusions 9–9*b* are also fitted into cylindrical fitting holes 10–10*b*, whereby a generally conical column base frame 1 as shown in FIG. 1 is completed.

Figure 7:
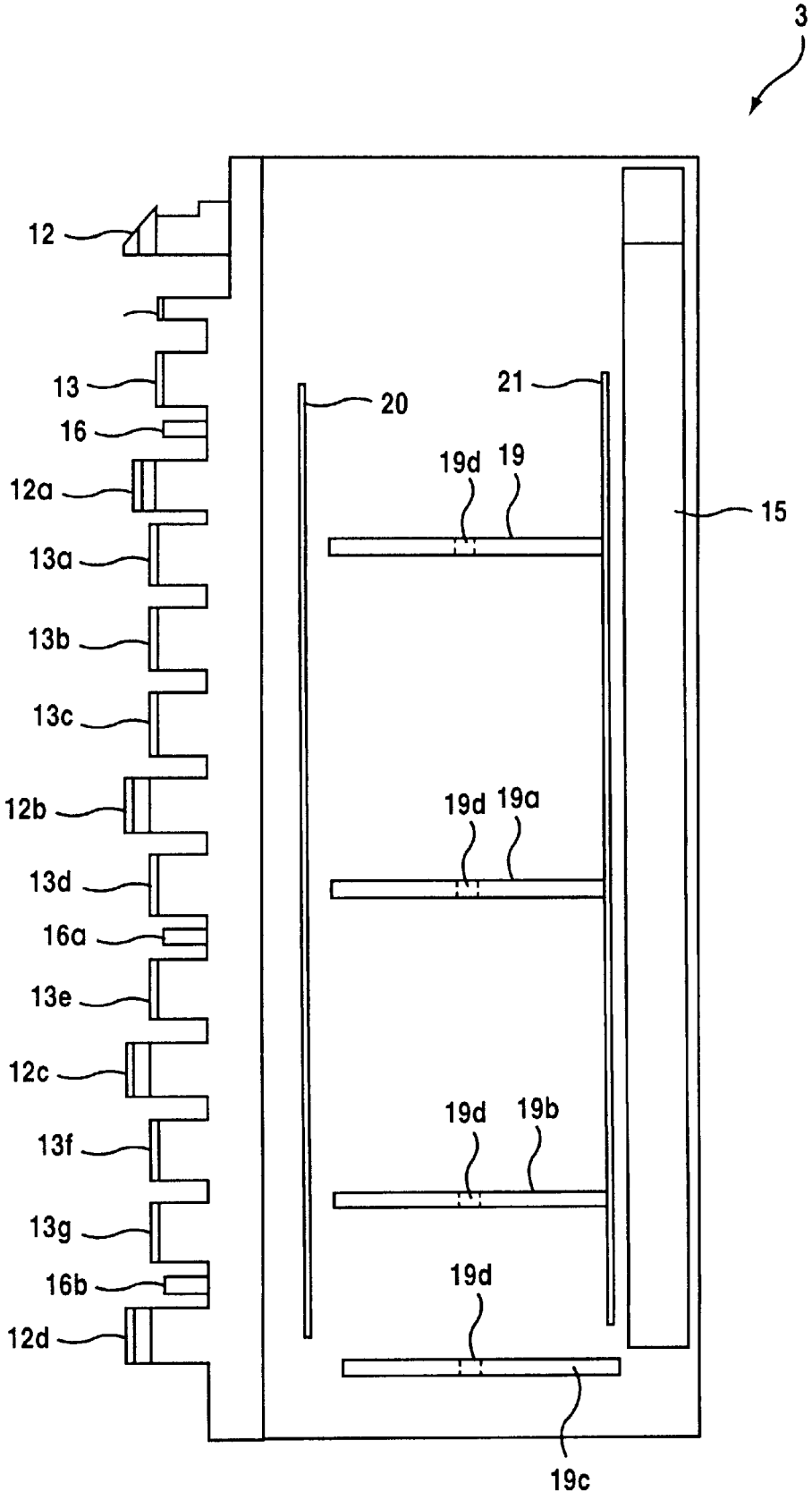
FIG. 7 is an elevational view of an increased frame constituting the column base frame with the opening prevention tool according to the present invention.
Figure 8:
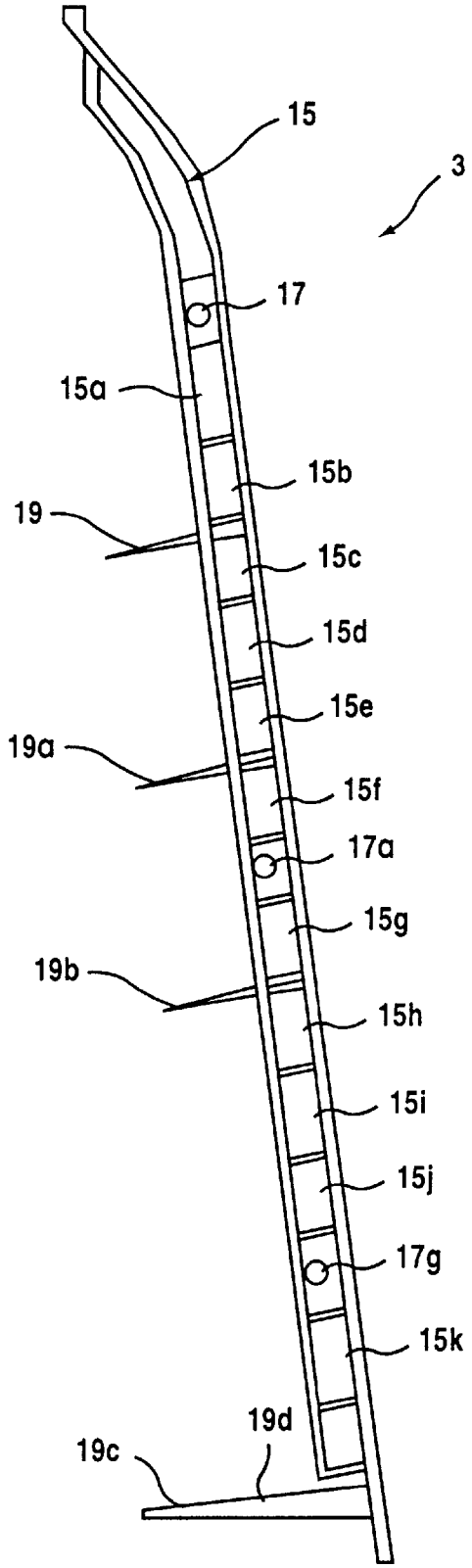
FIG. 8 is a right side view of the increased frame constituting the column base frame with the opening prevention tool according to the present invention.
Figure 9:
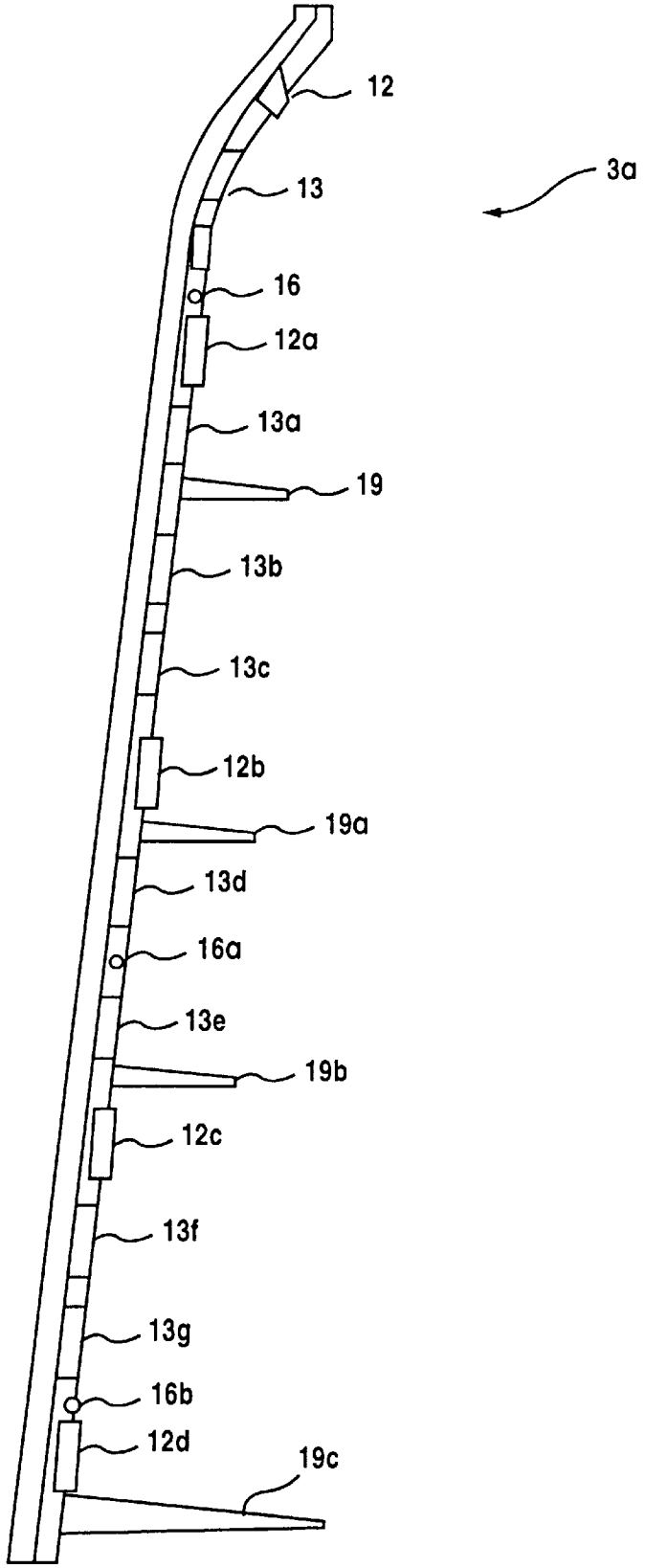
FIG. 9 is a left side view of the increased frame constituting the column base frame with the opening prevention tool according to the present invention.

FIGS. 7, 8 and 9 show an increased frame to be connected to the column base frame when the increased frame is added to the column base frame with the opening prevention tool according to the present invention. FIG. 7 is an elevational view of the increased frame. FIG. 8 is a right side view of the increased frame. FIG. 9 is a left side view of the increased frame.

As shown in FIG. 8, a plurality of fitting holes 15*a*–15*k* are formed in a fitting formation portion 15 on the right end of an increased frame 3. As shown in FIG. 9, a plurality of movable protrusions 12–12*d*, inserting protrusions 13–13*g* and cylindrical protrusions 16–16*b* are formed on the left end of the increased frame 3.

A plurality of protruding plates 19–19*c* are also protruded from the increased frame 3. Numerals 20 and 21 in FIG. 7 denote vertical protruding bars, and the vertical protruding bars 20, 21 are provided. Of course, these vertical protruding bars 20, 21 may not be provided.

Thus, the protruding plates 19–19*c* can prevent the column base frame 1 with the opening prevention tool from rising due to the weight of the fresh concrete, even if the fresh concrete is poured into the column base frame 1 with the opening prevention tool.

Numeral 19*d* denotes through holes for passing the opening prevention tool 20 and the opening prevention band 21 therethrough. Left and right overhangs 20*a*, 20*b* of the opening prevention tool 20 or umbrella-shaped protrusions 21*a*–21*b*, 23*a*–23*d* of the opening prevention band 21 are inserted or pressed into the through holes 19*d*, 19*d*, 19*d*, 19*d*, . . . bored through the protruding plates 19–19*c*. The fitting protruding bars may be disposed on the front and rear surfaces or the front surfaces alone of the inserting protrusions 13–13*g*.

Figure 10:
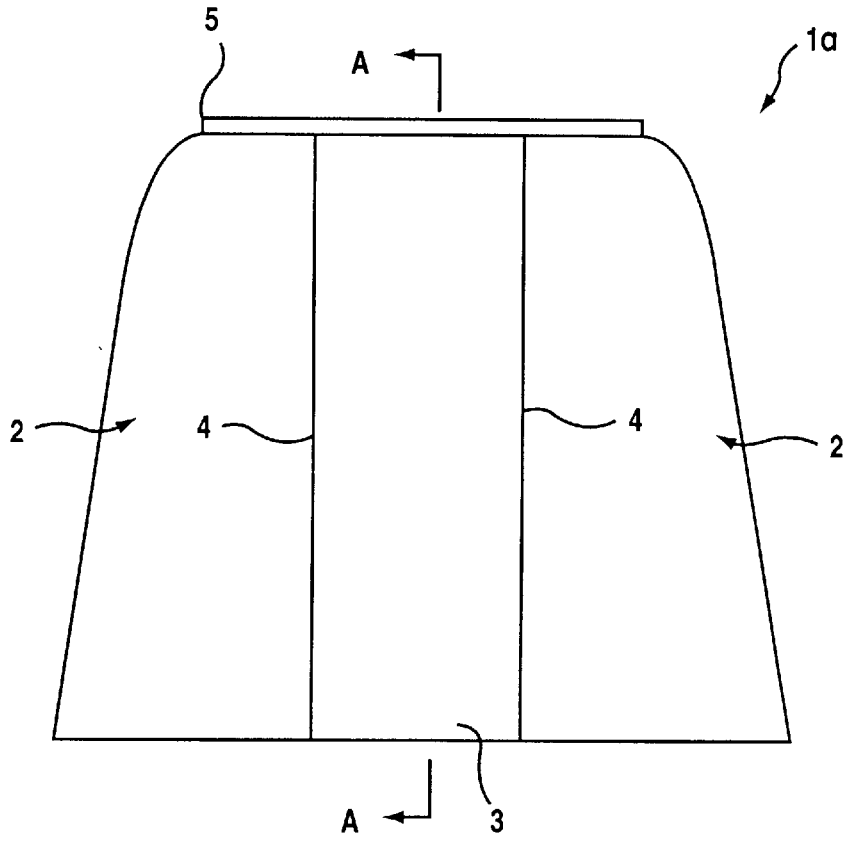
FIG. 10 is an elevational view of the assembled column base frame with the opening prevention tool according to the present invention.
Figure 11:
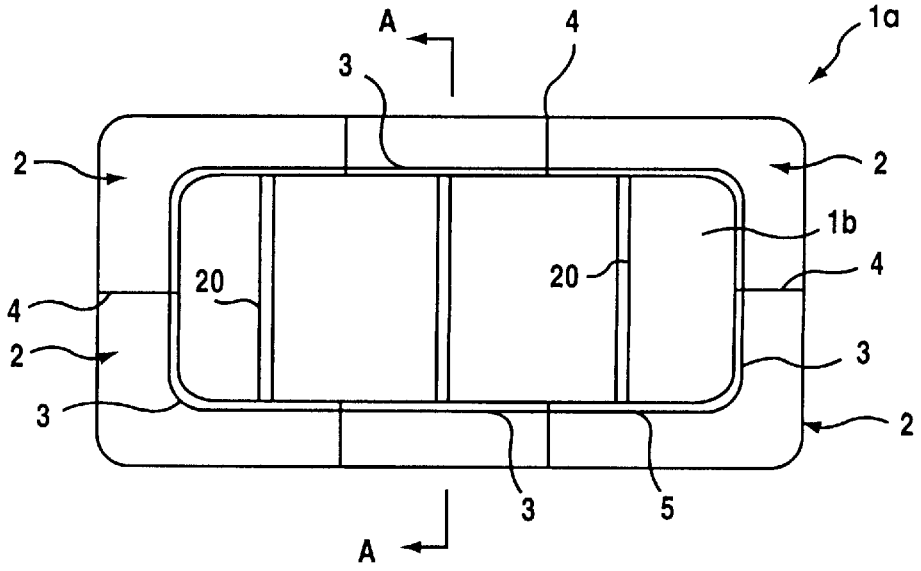
FIG. 11 is a plan view of other embodiment of the column base frame with the opening prevention tool according to the present invention.

FIGS. 10 and 11 show other embodiment of the column base frame 1 with the opening prevention tool assembled by the use of the corner frames 2 and the increased frames 3. FIG. 10 is an elevational view of other embodiment of the column base frame with the opening prevention tool according to the present invention. FIG. 11 is a plan view of the column base frame with the opening prevention tool of this embodiment.

A column base frame 1*a* with the opening prevention tool shown in FIGS. 10 and 11 is a combination of the four corner frames 2 and the two increased frames 3. As shown in FIG. 11, the column base frame 1*a* with the opening prevention tool is slightly horizontally longer in the plan view.

As shown in FIGS. 10 and 11, the opening prevention tools 20 of the same shape and the same size can be also mounted in the horizontally longer column base frame 1*a* with the opening prevention tool. That is, even if the column base frame 1 is replaced by the horizontally longer column base frame 1*a* with the opening prevention tool, it is not necessary to manufacture the opening prevention tool 20 itself of new size.

Figure 12:
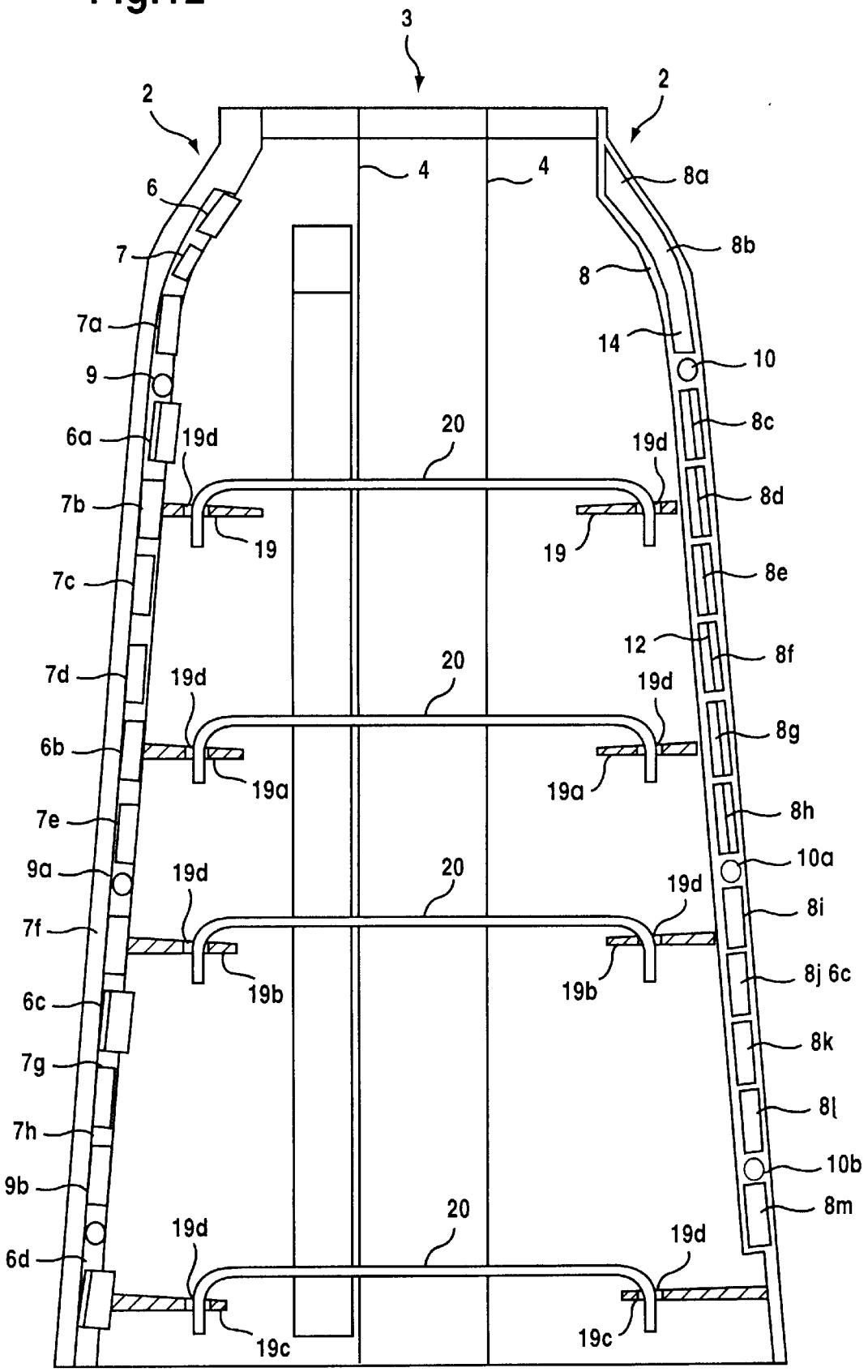
FIG. 12 is a longitudinal cross sectional view taken along line A—A of FIGS. 1 and 2.

FIG. 12 is a longitudinal cross sectional view taken along line A—A of FIGS. 10 and 11. As shown in FIG. 12, the opening prevention tools 20, 20, 20, 20 are mounted between the protruding plates 19, 19*a*, 19*b*, 19*c* and the protruding plates 19, 19*a*, 19*b*, 19*c* protruded from the increased frames 3, 3.

The column base frame 1*a* with the opening prevention tool of this embodiment, which is the combination of the corner frames 2 and the increased frames 3, is narrow in width in the upper portion thereof and is wide in width in the lower portion thereof. Therefore, the opening prevention tool 20 mounted between the protruding plates 19*a* and 19*a* must be slightly horizontally longer than the opening prevention tool 20 mounted between the protruding plates 19 and 19.

Also, the opening prevention tool 20 mounted between the protruding plates 19*b* and 19*b* must be slightly horizontally longer than the opening prevention tool 20 mounted between the protruding plates 19*a* and 19*a*.

However, in the column base frame 1*a* with the opening prevention tool of the present invention, the through holes 19*d*, 19*d*, 19*d*, 19*d*, . . . , which are formed in the protruding plates 19, 19*a*, 19*b*, 19*c* so as to pass the left and right overhangs 20*a*, 20*b* of the opening prevention tool 20 therethrough, are formed so that they may be more inside positioned as the protruding plates 19, 19*a*, 19*b*, 19*c* are more lowly positioned.

As described above, the more lowly the protruding plates 19, 19*a*, 19*b*, 19*c* are positioned, the more inside the through holes are formed. Therefore, the opening prevention tools 20 of the same shape and the same size can be mounted between the protruding plates 19, 19*a*, 19*b*, 19*c* and the protruding plates 19, 19*a*, 19*b*, 19*c*. Thus, there is no need for manufacturing the opening prevention tools 20 of different sizes.

Figure 13:
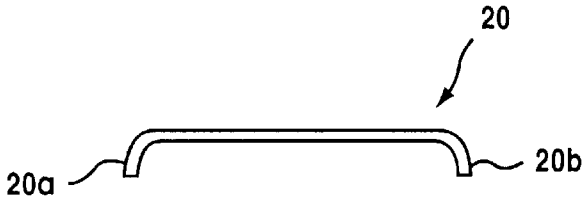
FIG. 13 is an elevational view of the opening prevention tool for use in the column base frame with the opening prevention tool according to the present invention.
Figure 13A:
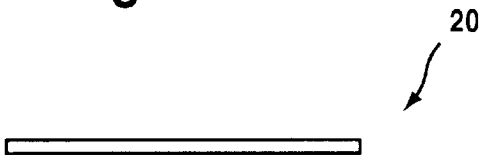
FIG. 13*a* is a plan view of the opening prevention tool for use in the column base frame with the opening prevention tool according to the present invention.
Figure 13B:
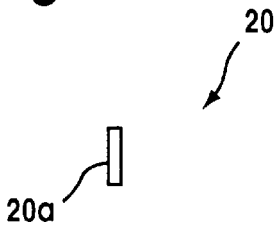
FIG. 13*b* is a left side view of the opening prevention tool for use in the column base frame with the opening prevention tool according to the present invention.
Figure 13C:
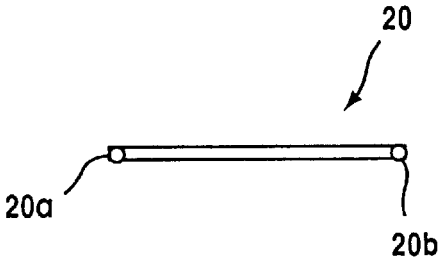
FIG. 13*c* is a bottom view of the opening prevention tool for use in the column base frame with the opening prevention tool according to the present invention.

FIGS. 13–13*c* show the opening prevention tool. FIG. 13 is an elevational view of the opening prevention tool for use in the column base frames 1, 1*a* with the opening prevention tool according to the present invention. FIG. 13*a* is a plan view of the opening prevention tool. FIG. 13*b* is a left side view of the opening prevention tool. FIG. 13*c* is a bottom view of the opening prevention tool.

The opening prevention tool 20 is shaped like a bracket ([), and the left and right overhangs 20*a*, 20*b* are formed on the left and right ends of the opening prevention tool 20. These left and right overhangs 20*a*, 20*b* are allowed to pass through the through holes 19*d*, 19*e*, 19*f*, 19*g* formed in the protruding plates 19, 19*a*, 19*b*, 19*c*.

Although a sectional shape of the opening prevention tool 20 is circular, the sectional shape is not necessarily circular but may be polygonal, for example, triangular and rectangular or may be ellipsoidal and rhombic.

Figure 14:
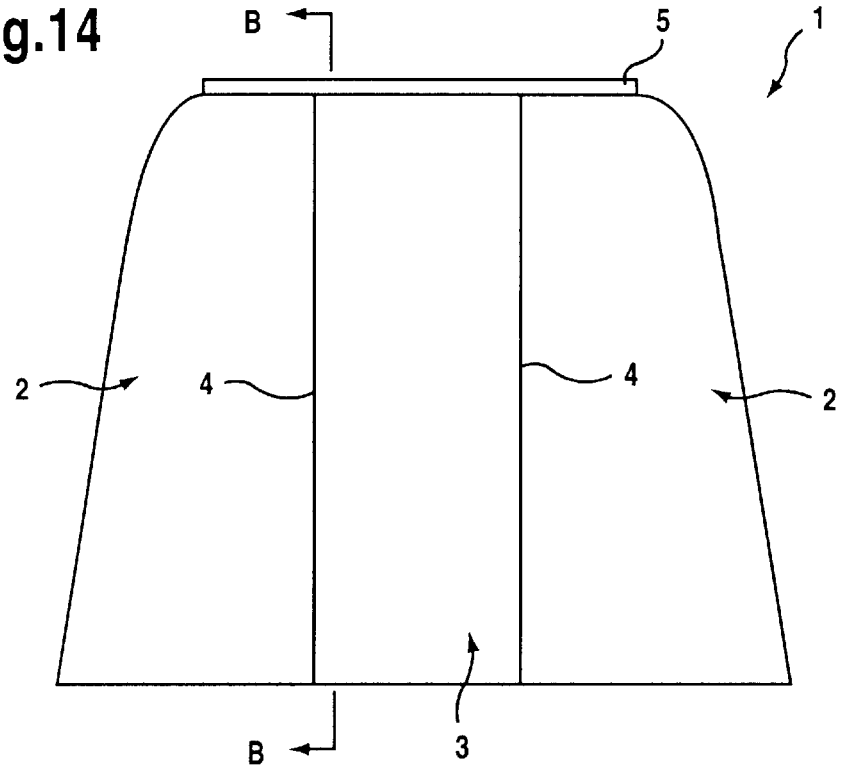
FIG. 14 is an elevational view of other embodiment of the column base frame with the opening prevention tool according to the present invention.
Figure 15:
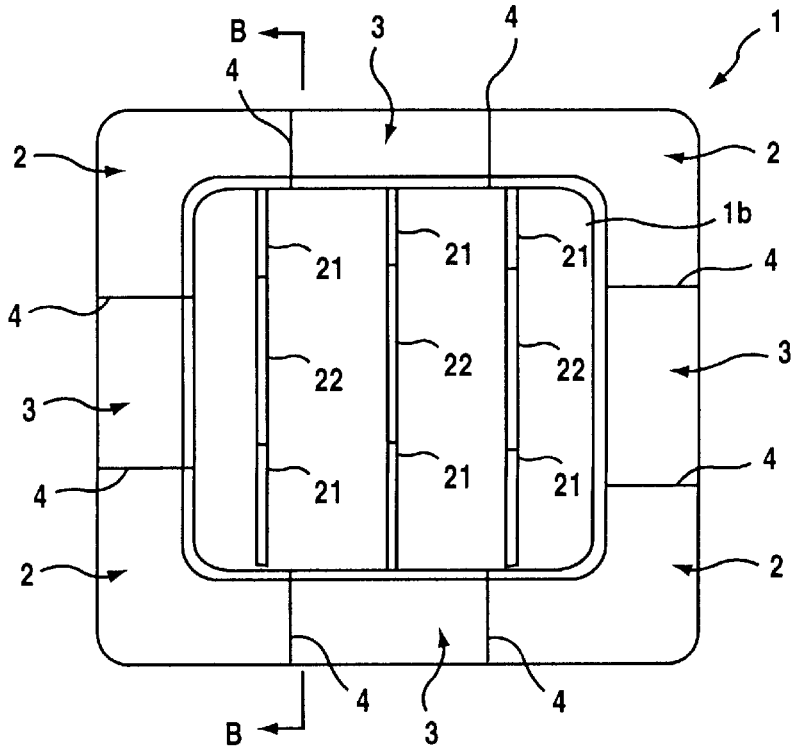
FIG. 15 is a plan view of other embodiment of the column base frame with the opening prevention tool according to the present invention.

FIG. 14 is an elevational view of other embodiment of the column base frame with the opening prevention tool according to the present invention. FIG. 15 is a plan view of other embodiment of the column base frame with the opening prevention tool according to the present invention.

A column base frame 1*b* with the opening prevention tool shown in FIGS. 14 and 15 is assembled by connecting the four corner frames 2 and the four increased frames 3. As shown in FIG. 14, the column base frame with the opening prevention tool is square in the plan view. Numeral 4 denotes the connecting portion. Numeral 21 denotes the opening prevention bands. Numeral 22 denotes the extending bands.

In the square column base frame 1*b* with the opening prevention tool such as this embodiment, in order to mount the opening prevention tools shown in FIGS. 13–13*c* between the protruding plates 19, 19*a*, 19*b*, 19*c* and the protruding plates 19, 19*a*, 19*b*, 19*c*, it is necessary to manufacture the opening prevention tools of individual sizes.

Figure 16:
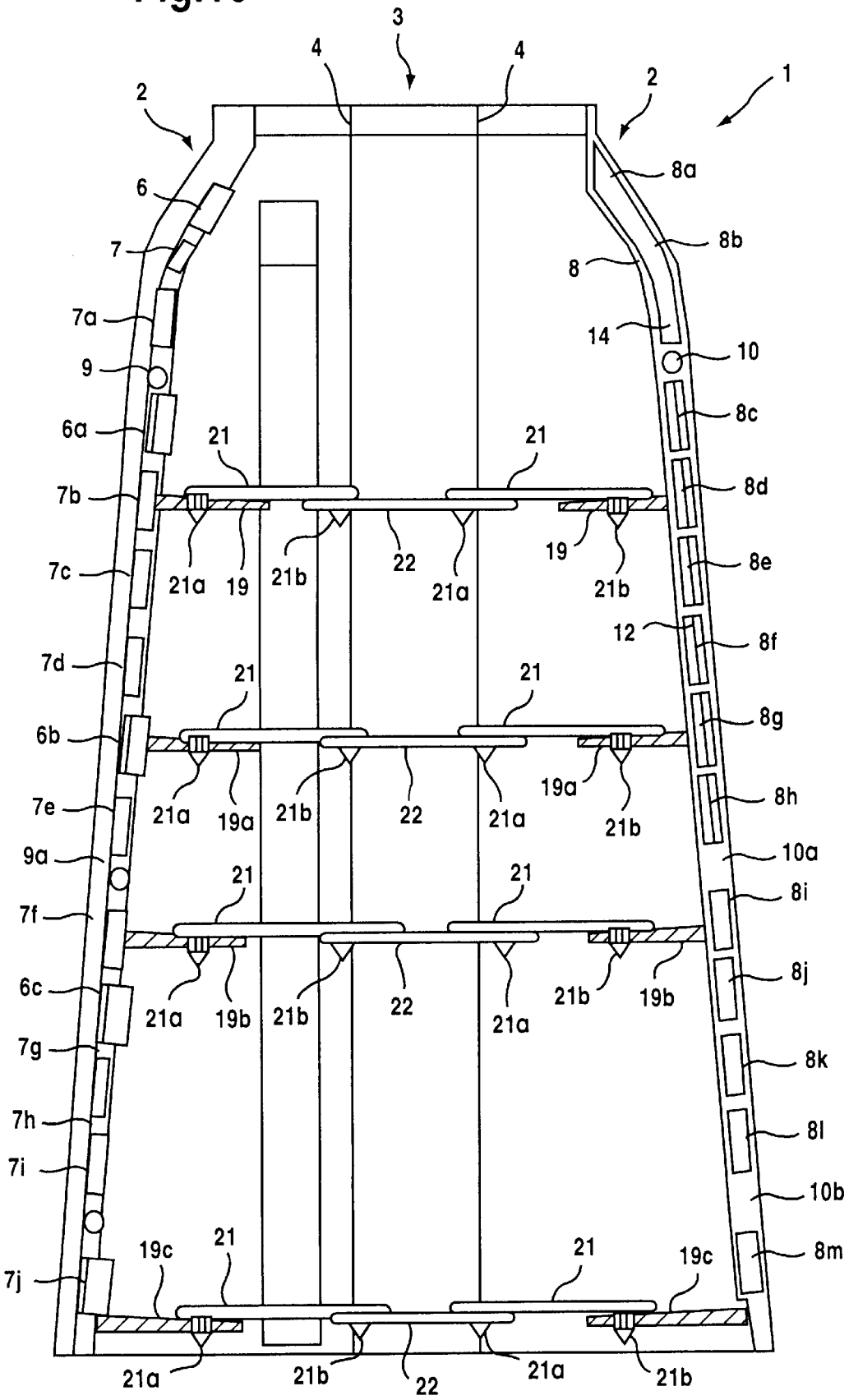
FIG. 16 is a longitudinal cross sectional view taken along line B—B of FIGS. 14 and 15.

FIG. 16 is a longitudinal cross sectional view taken along line B—B of FIGS. 14 and 15. As shown in FIG. 16, as the opening prevention tool mounted in the column base frame 1*b* with the opening prevention tool of the shape shown in FIGS. 14 and 15, the connection of the opening prevention bands 21, 21 and the extending band or bar 22 is used and mounted in the column base frame 1*b* with the opening prevention tool of this embodiment.

Figure 17:
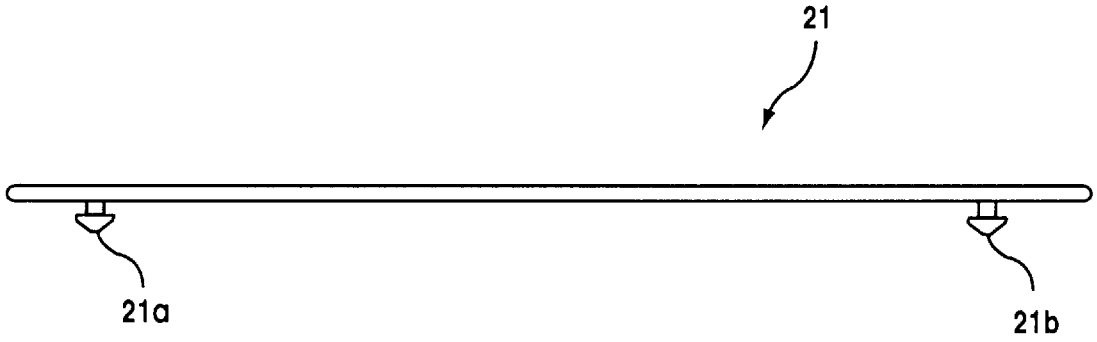
FIG. 17 is an elevational view of an opening prevention band for use in other embodiment of the column base frame with the opening prevention tool according to the present invention.
Figure 18:
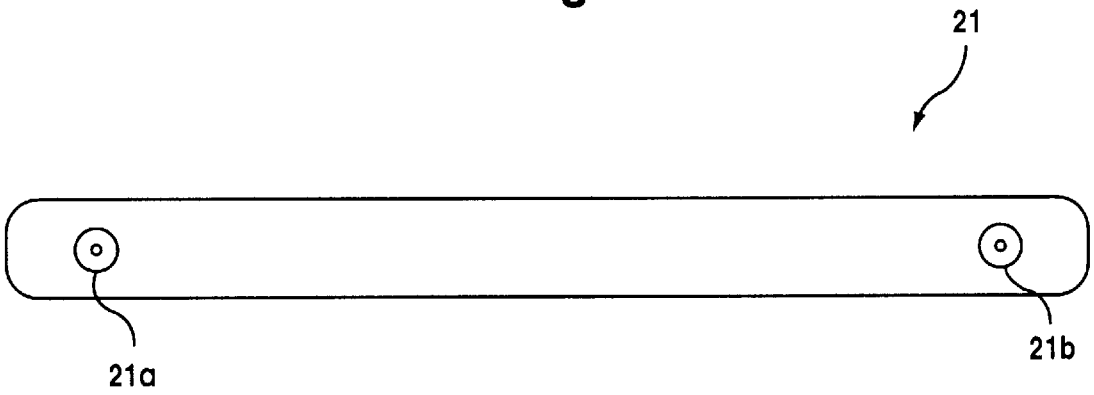
FIG. 18 is a bottom view of the opening prevention band for use in other embodiment of the column base frame with the opening prevention tool according to the present invention.

FIG. 17 is an elevational view of the opening prevention band for use in other embodiment of the column base frame with the opening prevention tool according to the present invention. FIG. 18 is a bottom view of the opening prevention band or bar. The left umbrella-shaped protrusion 21*a* and the right umbrella-shaped protrusion 21*b* are protruded from the lower surface on both the ends of the opening prevention band 21.

Figure 19:
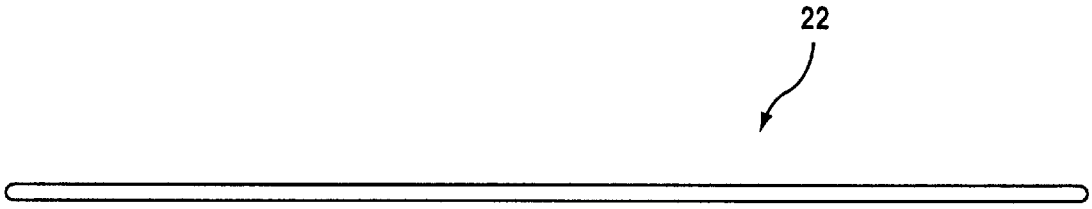
FIG. 19 is an elevational view of an extending band used by being connected to the opening prevention band of other embodiment of the column base frame with the opening prevention tool according to the present invention.
Figure 20:
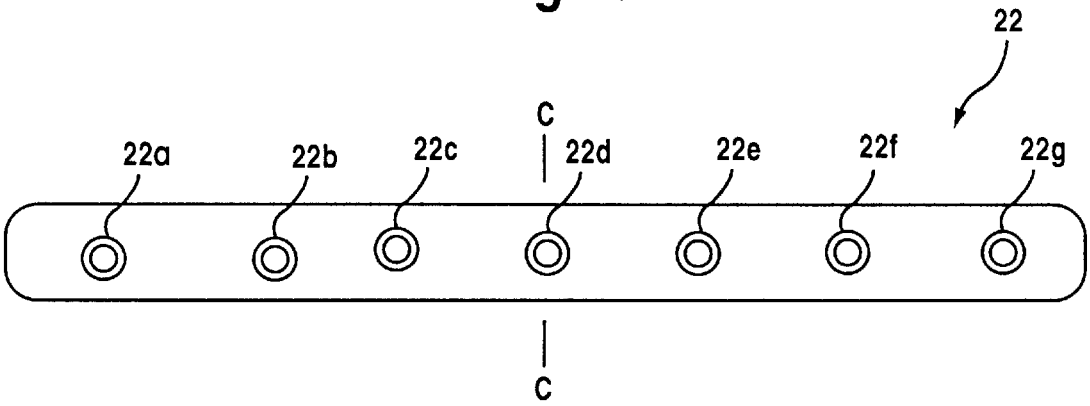
FIG. 20 is a bottom view of the extending band used by being connected to the opening prevention band of other embodiment of the column base frame with the opening prevention tool according to the present invention.

FIG. 19 is an elevational view of other embodiment of the extending band used by being connected to the opening prevention band of the column base frame with the opening prevention tool according to the present invention. FIG. 20 is a bottom view of the above-mentioned extending band. Press-fit holes 22*a*–22*g* are formed in the extending band 22 so that they may be equally spaced. The left and right protrusions 21*a*, 21*b* of the opening prevention band 21 are pressed into these press-fit holes 22*a*–22*g*.

Figure 20A:
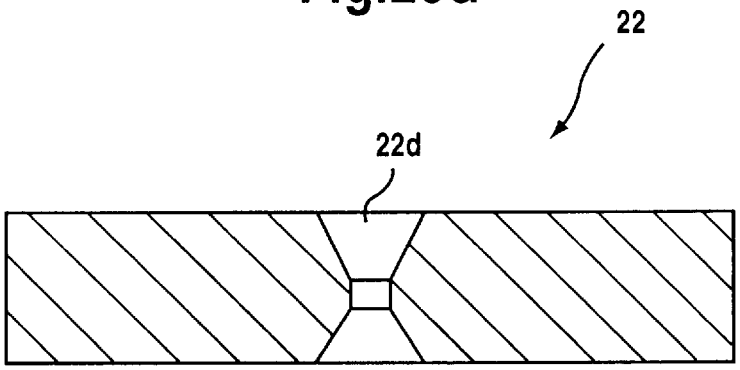
FIG. 20*a* is a cross sectional view taken along line C—C of FIG. 20.

FIG. 20*a* is a cross sectional view taken along line C—C of FIG. 20. As shown in FIG. 20*a*, the upper and lower openings of the press-fit hole 22*d* have a large diameter in order that they are widely spread, while the center thereof has a smaller diameter than the above-described openings. This structure is used in order that the protrusions 21*a*, 21*b* are easily pressed into the press-fit holes and are not easily removed from the press-fit holes.

Figure 21:
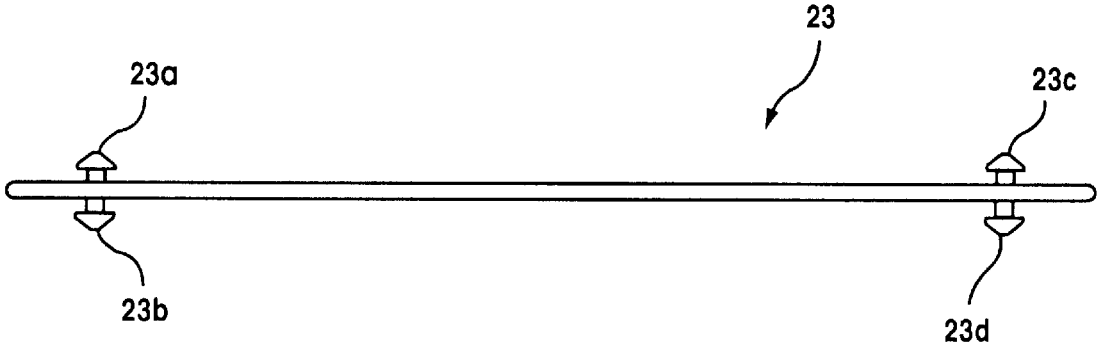
FIG. 21 is an elevational view of other embodiment of the opening prevention band for use in other embodiment of the column base frame with the opening prevention tool according to the present invention.
Figure 22:
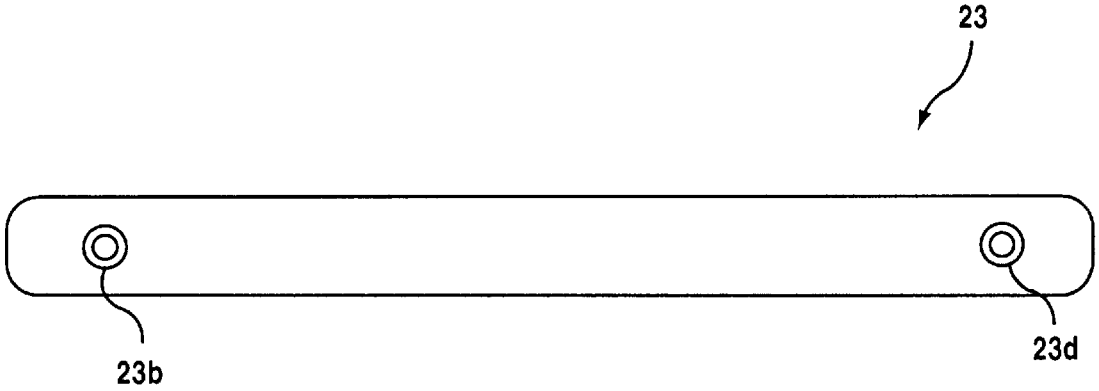
FIG. 22 is a bottom view of other embodiment of the opening prevention band for use in other embodiment of the column base frame with the opening prevention tool according to the present invention.

FIG. 21 is an elevational view of other embodiment of the opening prevention band for use in other embodiment of the column base frame with the opening prevention tool according to the present invention. FIG. 22 is a bottom view of other embodiment of the opening prevention band. As shown in FIGS. 21 and 22, the umbrella-shaped protrusions 23*a*, 23*b*, 23*c*, 23*d* are protruded from the upper and lower surfaces on the left and right ends of an opening prevention band 23 of this embodiment.

Figure 23:
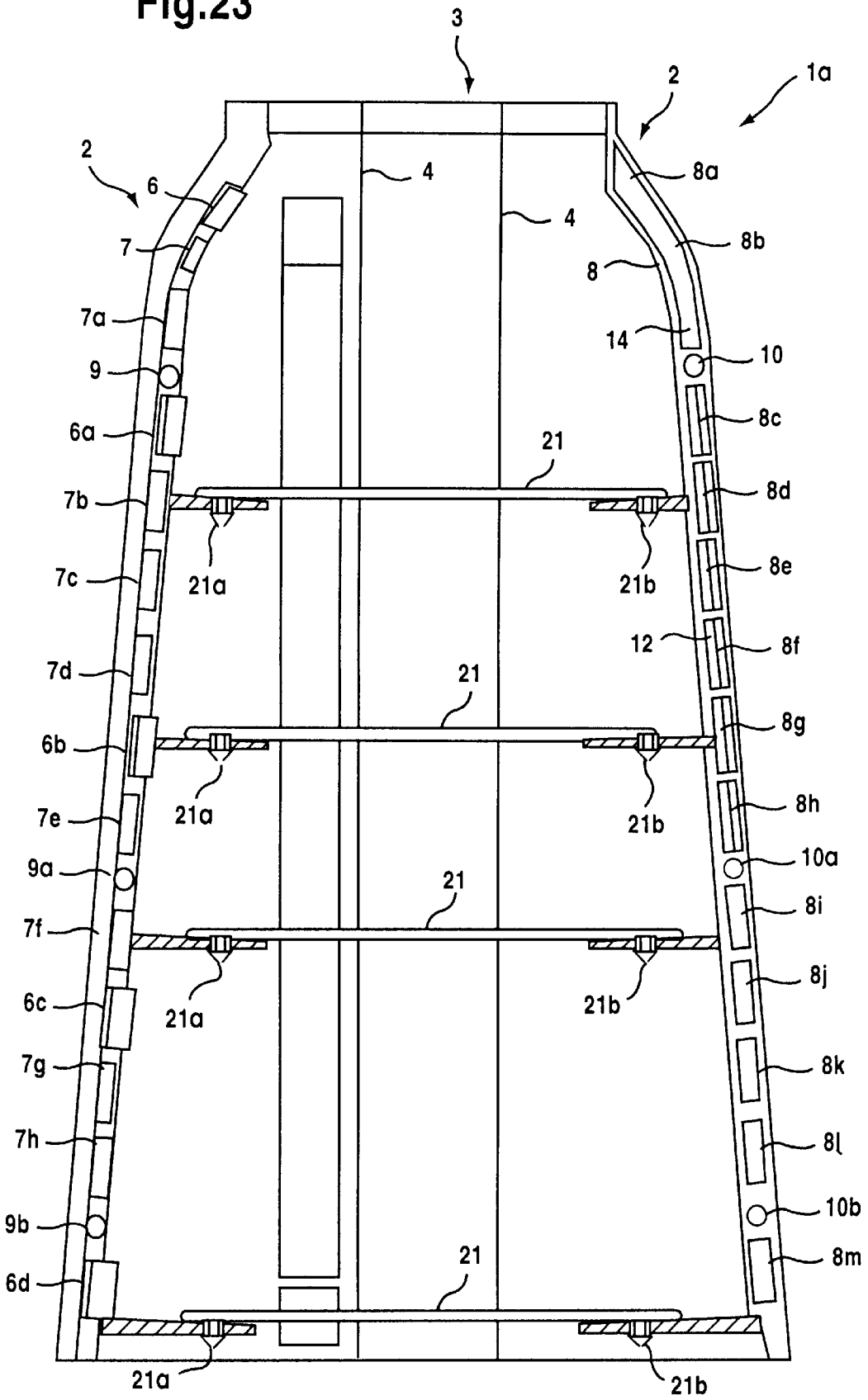
FIG. 23 is a longitudinal cross sectional view of other embodiment of the column base frame with the opening prevention tool according to the present invention to which the opening prevention bands alone shown in FIGS. 17 and 18 are mounted.

FIG. 23 is a longitudinal cross sectional view of other embodiment of the column base frame with the opening prevention tool according to the present invention to which the opening prevention bands alone shown in FIGS. 17 and 18 are mounted.

Figure 24:
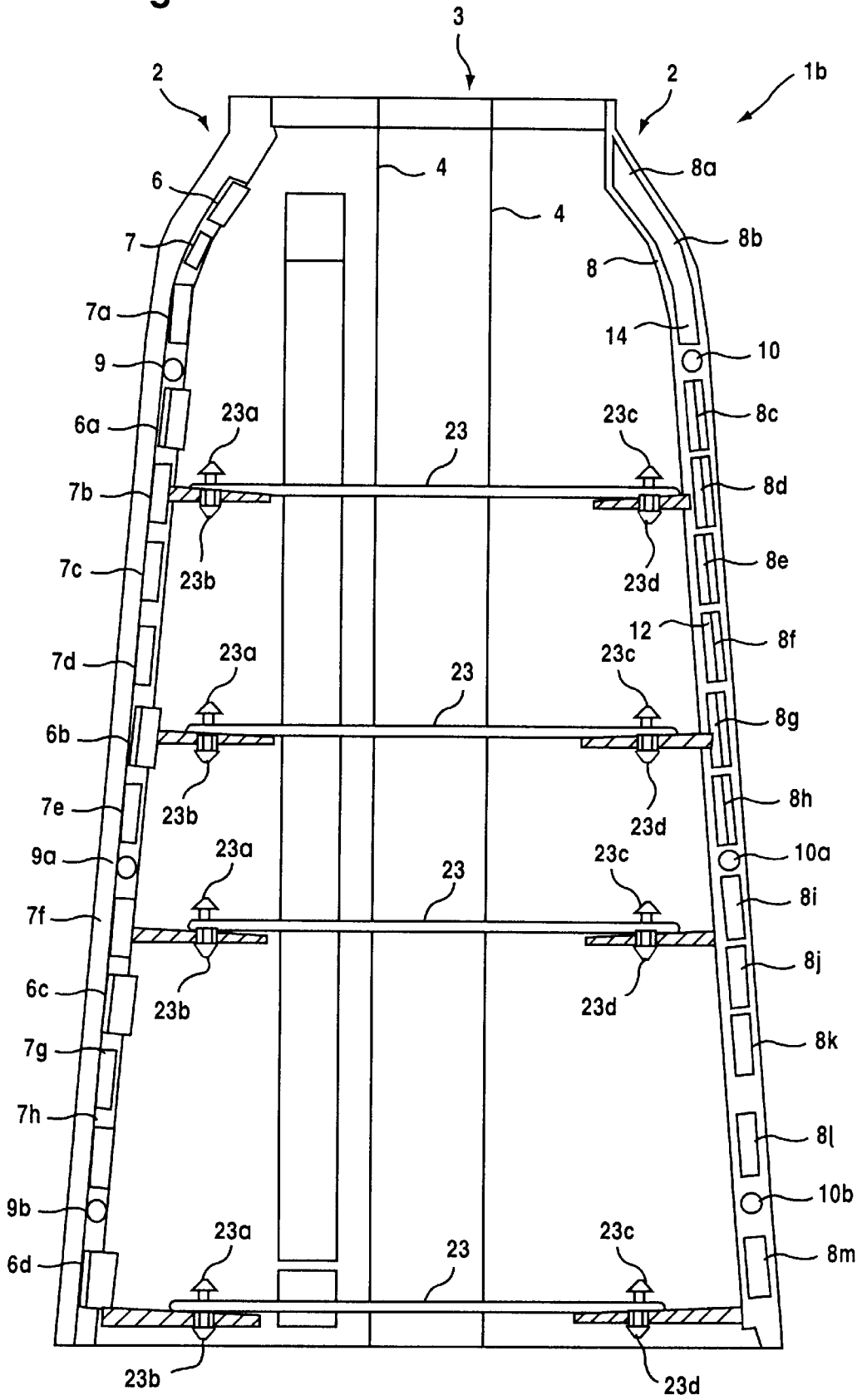
FIG. 24 is a longitudinal cross sectional view of other embodiment of the column base frame with the opening prevention tool according to the present invention to which the opening prevention bands and the extending bands shown in FIGS. 21 and 22 are connected.

FIG. 24 is a longitudinal cross sectional view of other embodiment of the column base frame with the opening prevention tool according to the present invention to which the opening prevention bands and the extending bands shown in FIGS. 21 and 22 are connected.

POSSIBILITY OF INDUSTRIAL UTILIZATION

Since the present invention is constituted as described above, it has the following effects.

Firstly, an assembled column base frame allows it to be not bulky during carrying it.

Secondly, the column base frame can be also mounted to a base of a column for supporting a piping.

Thirdly, the column base frame can be easily assembled in a building site.

Fourthly, since the column base frame is circularly formed, it is not dangerous.

Fifthly, a foundation work of a supporting column can be carried out for a short time.

Sixthly, the column base frame is not deformed by an expansion due to a weight of fresh concrete, even if the fresh concrete is poured into the column base frame.

What is claimed is:

1. An L-shaped corner frame member comprising:

two lateral ends, a top end and a bottom end;

fitting holes and cylindrical fitting holes on one of said lateral ends;

movable protrusions, inserting protrusions and cylindrical protrusions on the other of said lateral ends; and protruding plates through which through holes are bored, said protruding plates protruding from an inner face of said L-shaped corner frame member and being located away from the top and bottom ends.

2. An extension frame member comprising:

two lateral ends, a top end and a bottom end;

fitting holes and cylindrical fitting holes on one of said lateral ends;

movable protrusions, inserting protrusions and cylindrical protrusions on the other of said lateral ends; and protruding plates through which through holes are bored, said protruding plates protruding from an inner face of said extension frame member and being located away from the top and bottom ends.

3. A column base frame with an opening prevention tool, said column base frame being assembled by connecting L-shaped corner frame members, each of said L-shaped corner frame members comprising:

two lateral ends, a top end and a bottom end;

fitting holes and cylindrical fitting holes on one of said lateral ends;

movable protrusions, inserting protrusions and cylindrical protrusions on the other of said lateral ends; and protruding plates through which through holes are bored, wherein said movable protrusions and said inserting protrusions of each of said L-shaped corner frame members are inserted in said fitting holes of an adjacent L-shaped corner frame member among the others of said L-shaped corner frame members, and said cylindrical protrusions of each of said L-shaped corner frame members are inserted in said cylindrical fitting holes of an adjacent L-shaped corner frame member among the others of said L-shaped corner frame members, and wherein said opening prevention tool comprises protrusions and is mounted between said protruding plates by insertion of said protrusions of said opening prevention tool in said through holes of said protruding plates.

4. A column base frame with an opening prevention tool, said column base frame being assembled by connecting extension frame members to L-shaped corner frame members, each of said L-shaped corner frame members comprising:

two lateral end, a top end and a bottom end;

fitting holes and cylindrical fitting holes on one of said lateral ends;

movable protrusions, inserting protrusions and cylindrical protrusions on the other of said lateral ends; and protruding plates through which through holes are bored, each of said extension frame members comprising:

two lateral ends, a top end and a bottom end;

fitting holes and cylindrical fitting holes on one of said lateral ends;

movable protrusions, inserting protrusions and cylindrical protrusions on the other of said lateral ends; and protruding plates through which through holes are bored, wherein said movable protrusions and said inserting protrusions of each of said L-shaped corner frame members and extension frame members are inserted in said fitting holes of an adjacent L-shaped corner frame member or extension frame member among the others of said L-shaped corner frames and extension frames, and said cylindrical protrusions of each of said L-shaped corner frame members and extension frame members are inserted in said cylindrical fitting holes of an adjacent L-shaped corner frame member or extension frame member among the others of said L-shaped corner frame members and extension frame members, and wherein said opening prevention tool comprises protrusions and is mounted between said protruding plates by insertion of said protrusions of said opening prevention tool in said through holes of said protruding plates.

5. The column base frame with an opening prevention tool according to claim 3 or 4, wherein said opening prevention tool is an opening prevention bar.

6. The column base frame with an opening prevention tool according to claim 3 or 4, wherein said opening prevention tool comprises an opening prevention bar and an extension bar connected to said opening prevention bar.

* * * * *